US009689111B2

(12) United States Patent
White et al.

(10) Patent No.: US 9,689,111 B2
(45) Date of Patent: Jun. 27, 2017

(54) MICROWAVE INITIATION FOR DEPOSITION OF POROUS ORGANOSILICATE MATERIALS ON FABRICS

(71) Applicants: Brandy J. White, Washington, DC (US); Brian Melde, Alexandria, VA (US)

(72) Inventors: Brandy J. White, Washington, DC (US); Brian Melde, Alexandria, VA (US)

(73) Assignee: The Government of the United States of America, as represented by the Secretary of the Navy, Washington, DC (US)

( * ) Notice: Subject to any disclaimer, the term of this patent is extended or adjusted under 35 U.S.C. 154(b) by 617 days.

(21) Appl. No.: 14/209,728

(22) Filed: Mar. 13, 2014

(65) Prior Publication Data

US 2014/0273688 A1 Sep. 18, 2014

Related U.S. Application Data

(60) Provisional application No. 61/783,364, filed on Mar. 14, 2013.

(51) Int. Cl.

| | |
|---|---|
| ***D06M 10/00*** | (2006.01) |
| ***A62B 17/00*** | (2006.01) |
| ***D06M 10/08*** | (2006.01) |
| ***D06M 13/352*** | (2006.01) |
| ***D06M 13/507*** | (2006.01) |
| ***D06M 15/643*** | (2006.01) |

(52) U.S. Cl.

CPC ..... *D06M 10/003* (2013.01); *A62B 17/006* (2013.01); *D06M 10/08* (2013.01); *D06M 13/352* (2013.01); *D06M 13/507* (2013.01); *D06M 15/643* (2013.01); *Y10T 442/2516* (2015.04)

(58) Field of Classification Search

CPC .. A62B 17/006; D06M 10/003; D06M 10/08; D06M 13/352; D06M 13/507; D06M 15/643; Y10T 442/2516

See application file for complete search history.

(56) References Cited

U.S. PATENT DOCUMENTS

| | | | |
|---|---|---|---|
| 2,386,259 | A | 10/1945 | Norton et al. |
| 5,085,938 | A | 2/1992 | Watkins |
| 8,062,414 | B2 | 11/2011 | Nakashima et al. |

FOREIGN PATENT DOCUMENTS

| | | | |
|---|---|---|---|
| CN | 101804327 | A | 8/2010 |
| JP | 2003082557 | A | 3/2003 |
| JP | 2009030200 | A | 2/2009 |
| KR | 10-2011-0024830 | | 3/2011 |
| WO | 98-39497 | | 9/1998 |
| WO | 2010087887 | A1 | 8/2010 |

OTHER PUBLICATIONS

C. T. Kresge; M. E. Leonowicz; W. J. Roth; J. C. Vartuli; J. S. Beck, 1992, "Ordered mesoporous molecular sieves synthesized by a liquid-crystal template mechanism," Nature 359, 710-712.

M. C. Burleigh; M. A. Markowitz; E. M. Wong; J. S. Lin; B. P. Gaber, 2001, "Synthesis of periodic mesoporous organosilicas with block copolymer templates," Chem Mater 13, 4411-4412.

Y. Goto; S. Inagaki, 2002, "Synthesis of large-pore phenylene-bridged mesoporous organosilica using triblock copolymer surfactant," Chem Commun 2410-2411.

R. J. P. Corriu; D. Leclercq, 1996, "Recent developments of molecular chemistry for sol-gel processes," Angewandte Chemie-International Edition in English 35, 1420-1436.

Q. S. Huo; D. I. Margolese; G. D. Stucky, 1996, "Surfactant control of phases in the synthesis of mesoporous silica-based materials," Chem Mater 8, 1147-1160.

K. Kosuge; T. Murakami; N. Kikukawa; M. Takemori, 2003, "Direct Synthesis of Porous Pure and Thiol-Functional Silica Spheres through the S+X-I+ Assembly Pathway," Chem. Mater. 15, 3184-9.

A. Matsumoto; H. Misran; K. Tsutsumi, 2004, "Adsorption characteristics of organosilica based mesoporous materials," Langmuir 20, 7139-7145.

A. Palaniappan; X. Su; F. E. H. Tay, 2006, "Functionalized mesoporous silica films for gas sensing applications," J Electroceram 16, 503-505.

F. Hoffmann; M. Cornelius; J. Morell; M. Fröba, 2006, "Silica-Based Mesoporous Organic-Inorganic Hybrid Materials," Angew Chem Int Edit 45, 3216-3251.

J. Weitkamp; M. Hunger; U. Rymsa, 2001, "Base catalysis on microporous and mesoporous materials: recent progress and perspectives," Micropor Mesopor Mat 48, 255-270.

D. Brunel; F. Fajula; J. B. Nagy; B. Deroide; M. J. Verhoef; L. Veum; J. A. Peters; H. van Bekkum, 2001, "Comparison of two MCM-41 grafted TEMPO catalysts in selective alcohol oxidation," Applied Catalysis a-General 213, 73-82.

B. J. Johnson; B. J. Melde; P. T. Charles; D. C. Cardona; M. A. Dinderman; A. P. Malanoski; S. B. Qadri, 2008, "Imprinted Nanoporous Organosilicas for Selective Adsorption of Nitroenergetic Targets," Langmuir 24, 9024-9029.

B. J. Johnson; B. J. Melde; P. T. Charles; M. A. Dinderman; A. P. Malanoski; I. A. Leska; S. A. Qadri, 2010, "Macroporous Silica for Concentration of Nitroenergetic Targets," Talanta 81, 1454-60.

B. J. Johnson; B. J. Melde; I. A. Leska; P. T. Charles; A. D. Hewitt, 2011, "Solid-phase extraction using hierarchical organosilicates for enhanced detection of nitroenergetic targets," J Environ Monitor 13, 1404-9.

(Continued)

*Primary Examiner* — Arti Singh-Pandey

(74) *Attorney, Agent, or Firm* — US Naval Research Laboratory; Roy Roberts

(57) ABSTRACT

Described herein are modification of fabrics using a microwave initiation technique to produce a porous coating on the fibers providing adsorbent properties as well as the potential for further modification. In embodiments, the fabric incorporates a periodic mesoporous organosilica compound (PMO) optionally bound to a porphyrin or other functional group, and/or a catalyst or optical indicator.

16 Claims, 5 Drawing Sheets

(56) References Cited

OTHER PUBLICATIONS

B. J. Johnson; B. J. Melde; G. W. Peterson; B. J. Schindler; P. Jones, 2012, "Functionalized organosilicate materials for irritant gas removal," Chem Eng Sci 68, 376-382.

B. J. Johnson; N.E. Anderson; P. T. Charles; A. P. Malanoski; B. J. Melde; M. Nasir; J. R. Deschamps, 2011, "Porphyrin-Embedded Silicate Materials for Detection of Hydrocarbon Solvents," Sensors 11, 886-904.

B. J. Johnson; I. A. Leska; B. J. Melde; J. R. Taft, 2012, "Removal of phosgene by metalloporphyrin-functionalized porous organosilicates" Catal. Commun. 27, 105-8.

B. J. Johnson; I. A. Leska; B. J. Melde; J. R. Taft, 2012, "Self-Reporting Materials: Dual Use for Porphyrin-Embedded Sorbents," Sensor Actuat B-Chem 176, 399-404.

B. J. Johnson; J. Melde; P. T. Charles; A. P. Malanoski, 2009, "Porphyrin-embedded organosilicas for detection and decontamination," 2009 SPIE International Defense, Security and Sensing Symposium, Orlando, FL, #14.

B J. Johnson; B. J. Melde; C. Thomas; A. P. Malanoski; I. A. Leska; P. T. Charles; D. A. Parrish; J. R. Deschamps, 2010, "Fluorescent Silicate Materials for the Detection of Paraoxon," Sensors 10, 2315-2331.

B. Johnson-White; M. Zeinali; A. P. Malanoski; M. Dinderman, 2007, "Sunlight catalyzed conversion of cyclic organics with novel mesoporous organosilicas," Catalysis Comm 8, 1052-1056.

B. Johnson-White; Zeinali; K. M. Shaffer; J. C. H. Patterson; P. T. Charles; M. A. Markowitz, 2007, "Detection of organics using porphyrin embedded nanoporous organosilicas," Biosens Bioelectron 22, 1154-1162.

R. A. Hayn; J. R. Owens; S. A. Boyer; R. S. McDonald; H. J. Lee, 2011, "Preparation of highly hydrophobic and oleophobic textile surfaces using microwave-promoted silane coupling," Journal of Materials Science 46, 2503-2509.

K. Nakanishi; T. Amatani; S. Yano; T. Kodaria, 2008, "Multiscale Templating of Siloxane Gels via Polymerization-Induced Phase Separation," Chem Mater 20, 1108-1115.

K. Nakanishi; Y. Kobayashi; T. Amatani; K. Hirao; T. Kodaira, 2004, "Spontaneous Formation of Hierarchical Macro-Mesoporous Ethane-Silica Monolith," Chem Mater 16, 3652-3658.

J.R. Owens; R.A. Hayn; S.A. Boyer; R.S. McDonald, 2008, "Synthesis of hydrophobic and oleophobic nylon-cotton fabric through microwave catalyzed silane attachment," AFRL Report #AFRL-RX-TY-TP-2008-4619.

S. Sundarrajan, A.R. Chandrasekaran, S. Ramakrishna "An Update on Nanomaterials-Based Textiles for Protection and Decontamination," J. Am. Ceram. Soc. 2010, 93, 3955-3975.

International Search Report for PCT /US2014/026398.

Written Opinion of the International Searching Authority for PCT /US2014/026398.

Extended European Search Report in EP application 14770433.2, dated Sep. 23, 2016.

Ringot et al., "Porphyrin-grafted cellulose fabric" Materials Letters, Elsevier, 2009, 63 (21), pp. 1889-1891.

MICROWAVE INITIATION FOR DEPOSITION OF POROUS ORGANOSILICATE MATERIALS ON FABRICS

CROSS-REFERENCE TO RELATED APPLICATIONS

This application claims the benefit of U.S. Provisional Application 61/783,364 filed on Mar. 14, 2013.

BACKGROUND

Traditional protective garments and shelters frequently utilize carbon materials such as activated carbon. These materials are typically reliant on non-specific adsorption, may provide little to no catalytic/reactive activity, and do not protect against the full range of threat agents. Furthermore, protective garments often provide little to no water transport across protective barriers, resulting in discomfort to the wearer and limiting the duration of their use. A need exists for fabrics addressing these short-comings.

BRIEF SUMMARY

In a first embodiment, a modified fabric includes a fabric in a state of being modified by wetting the fabric in a first solution comprising tetraethylorthosilicate (TEOS) to obtain a precursor fabric, and irradiating the precursor fabric with microwave radiation to obtain a TEOS functionalized fabric.

A second embodiment further comprises dip-coating the TEOS functionalized fabric in a dip solution comprising surfactant and organosilica precursor to obtain dipped fabric, and curing the dipped fabric to obtain a modified fabric.

In another embodiment, a method of treating fabric includes wetting a fabric in a first solution comprising tetraethylorthosilicate (TEOS) to obtain a precursor fabric, and irradiating the precursor fabric with microwave radiation to obtain a TEOS functionalized fabric. The method optionally includes dip-coating the TEOS functionalized fabric in a dip solution comprising surfactant and organosilica precursor to obtain dipped fabric, and curing the dipped fabric to obtain a modified fabric.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION

Definitions

Figure 1A:
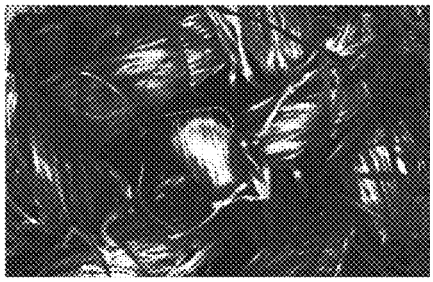
FIGS. 1A-1F show scanning electron microscopy (SEM) images of fabrics before and after tetraethylorthosilicate (TEOS) functionalization: unbleached cotton (A), ACU (B), multi-cam (C) and of TEOS functionalized fabrics: 1 cycle (D), 3 cycles (E), 10 cycles (F).

Before describing the present invention in detail, it is to be understood that the terminology used in the specification is for the purpose of describing particular embodiments, and is not necessarily intended to be limiting. Although many methods, structures and materials similar, modified, or equivalent to those described herein can be used in the practice of the present invention without undue experimentation, the preferred methods, structures and materials are described herein. In describing and claiming the present invention, the following terminology will be used in accordance with the definitions set out below.

As used in this specification and the appended claims, the singular forms "a", "an," and "the" do not preclude plural referents, unless the content clearly dictates otherwise.

As used herein, the term "and/or" includes any and all combinations of one or more of the associated listed items.

As used herein, the term "about" when used in conjunction with a stated numerical value or range denotes somewhat more or somewhat less than the stated value or range, to within a range of ±10% of that stated.

Description

The fabric modifications described here provide the potential for designing fabrics that provide a barrier to penetration of threat agents. They can be tailored to provide varied selectivity and binding capacity for different targets. Modifications can be made to a range of different types of fabrics facilitating application to individual and collective protection scenarios. The sorbents can be further modified using catalytic, antimicrobial, or other functional groups. This capability provides the opportunity for development of self-decontaminating materials or materials for utilization in sensing applications.

Described herein are modification of fabrics using a microwave initiation technique to produce a porous coating on the fibers providing adsorbent properties as well as the potential for further modification by functional groups (e.g., porphyrins), catalysts, and optical indicators.

Periodic mesoporous organosilicas (PMOs) are organic-inorganic materials with highly ordered pore networks and large internal surface areas (typically >1,000 $m^2/g$). The materials are synthesized using a surfactant template approach. See refs. 1-3. and have narrow pore size distributions with few blocked pores or obstructions facilitating molecular diffusion throughout the pore networks. The alternating siloxane and organic moieties give PMOs properties associated with both organic and inorganic materials. See refs. 4, 5. The siloxane groups provide the structural rigidity required to employ surfactant templating methods which provide precise control when engineering porosity. The incorporated organic groups provide binding characteristics which are normally associated with organic polymers. It is also possible to synthesize materials with morphological properties spanning several length scales. These hierarchical structures can be used to provide improved accessibility to the surface area of the materials.

PMOs have been applied to adsorption of targets from aqueous solution as well as to the adsorption of vapors. See refs. 6-8. They are considered exceptionally suitable for catalytic applications. The well-organized pore systems and large pore diameters provide an avenue for incorporation of complex structures that are not feasible in amorphous aero- and xerogels. In addition, the generation of higher molecular weight products can be accommodated. See refs. 9-11. Efforts have resulted in the development of a range of PMO and hierarchical materials providing binding affinity and capacity for targets such as nitroenergetics, phosgene, ammonia, and organophosphates. See refs. 12-15. The incorporation of porphyrins into PMOs provides a high density of binding sites with specificity for the targeted contaminant and brings the catalyst/indicator and target into close proximity. Both the PMO and porphyrin components of the materials are highly stable resisting extremes in temperature and offering extended shelf lives with no need for special storage conditions. These materials have been applied to adsorption, detection, and photocatalytic conversion of targets. See refs. 16-24.

Previously described PMO materials have been applied in powder or thin film formats. Described herein is a method for application of similar techniques to the generation of functionalized fabrics in order to bring the capabilities of the organosilicate and porphyrin-modified organosilicate sorbents to protective applications. The envisioned applications include protective garments, shelters, and filtration materials.

Description and Operation

Microwave Initiation

Figure 1B:
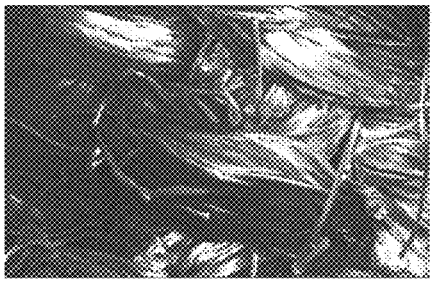
Figure 1C:
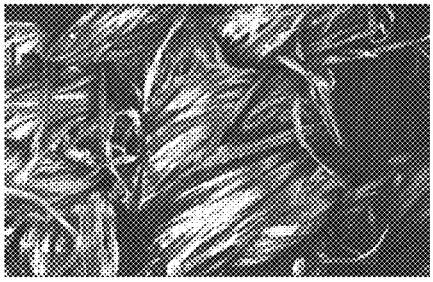
Figure 1D:
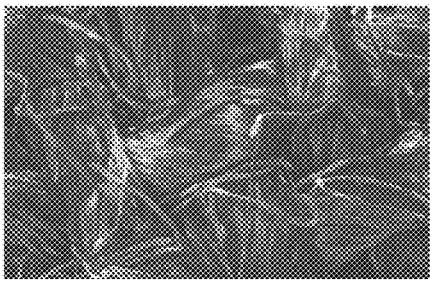
Figure 1E:
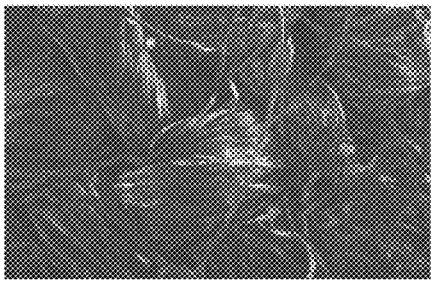
Figure 1F:
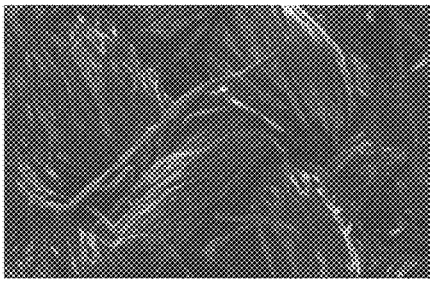

Fabric samples including unbleached cotton and military uniform fabrics (the Army Combat Uniform and Multi-CAM) were modified using tetraethylorthosilicate (TEOS). The protocol was developed based on a technique used for creating hydrophobic coatings on fabrics (see ref. 25), however, instead of making a hydrophobic coating, the chemistry used in this process provides sites that can be further modified through silane chemistry allowing for a subsequent dip coating process. SEM images of the three starting fabrics are shown in FIGS. 1A-1C. Both the ACU (FIG. 1B) and multi-cam fabrics (FIG. 1C) have flat fibers. Those of the ACU are more smoothly woven and have less texture on the surface of the fibers. The Multi-cam fabrics have fibers that are slightly smaller than those of the ACU. The fibers of the cotton fabric (FIG. 1A), while still flattened in one dimension are thicker and narrower than those of the other fabrics. The cotton fabric has the loosest weave of the three fabrics The microwave initiated technique involves wetting the fabric in a solution containing 1% ammonium hydroxide and 3% silane precursor in isopropyl alcohol. The excess liquid is gently squeezed from the fabric and it is immediately microwaved (1000 W) for 30 sec. The sample is then moved to an oven at 110° C. and dried. The wetting/microwave process can be repeated multiple times for increased coverage. TEOS precursor was used to prepare 1 cycle, 3 cycle, and 10 cycle samples. Control samples using only the base catalyst with the rest of the process were prepared for comparison. SEM images for the materials are in FIGS. 1D-1F. Changes in the surface of the fibers are obvious as the number of application cycles is increased. A significant increase in roughness was observed for the 10-cycle as compared to the 1- or 3-cycle additions Dip Coating Two materials previously developed for synthesis in monolithic formats were adapted for use in fabric modification. See refs. 15, 21, 26, 27. The first material utilizes a mixture of ethane and diethylbenzene bridging groups to provide binding affinity and capacity for organophosphate targets. The dip solution was prepared by mixing 3.5 g Pluronic F127, 2.62 g 1,2-bis(trimethoxysilyl)ethane (BTE), 1.56 g 1,4-bis(trimethoxysilylethyl)benzene (DEB), and 6 g methanol at room temperature. After thoroughly mixing, 1.5 g 0.05 M hydrochloric acid was added drop-wise. The solution was stirred for a minimum of 5 h up to 24 h with a tightly sealed lid. Fabric swatches were dipped into the preparation at 150 mm/min insuring that the wet fabric did not come into contact with solid surfaces. The swatches were cured while hanging at 60° C. for 24 h followed by 80° C. for 24 h. The Pluronic surfactant was then removed by heating the material in ethanol at 65° C. for 48 h followed by air drying at room temperature.

Figure 2A:
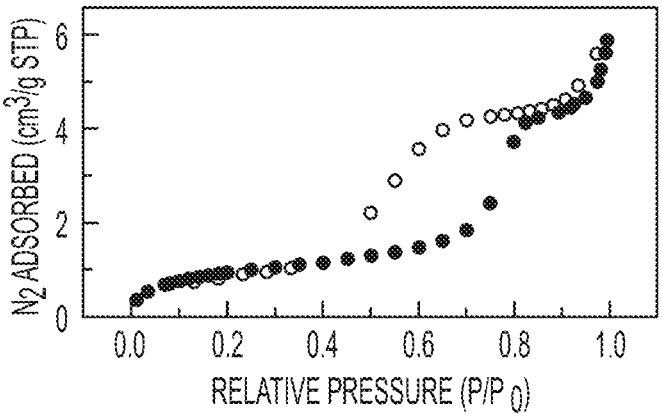
FIGS. 2A and 2B show nitrogen adsorption (A) and pore size distribution (B) for fabric modification using bis(trimethoxysilylethyl)benzene (DEB) and bis(trimethoxysilyl)ethane (BTE).
Figure 2B:
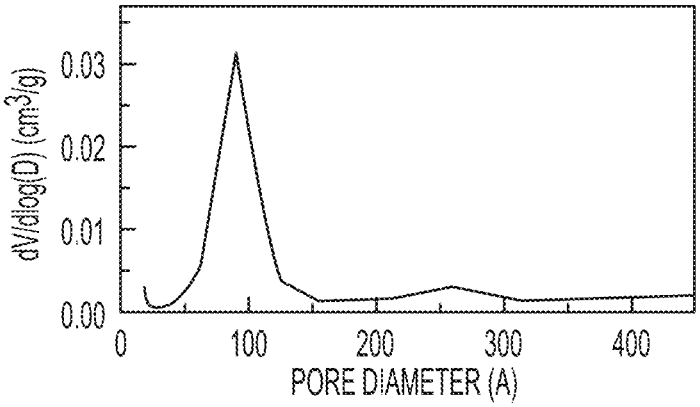

The resulting cotton samples consisted of approximately 2.1 mg of sorbent per square centimeter of fabric surface. Overall, samples had a BET surface area of 3.6 $m^2/g$ and a pore volume of 0.01 cm3/g with an average pore diameter of 90 Å (FIG. 2B). When these values are corrected for the weight of the fabric which has no significant inherent surface area or pore volume, the sorbent has a surface area of 22 $m^2/g$ and a pore volume of 0.06 $cm^3/g$. FIGS. 2A and 2B show nitrogen adsorption (A) and pore size distribution (B) for DEB-BTE fabric modification.

Figure 3A:
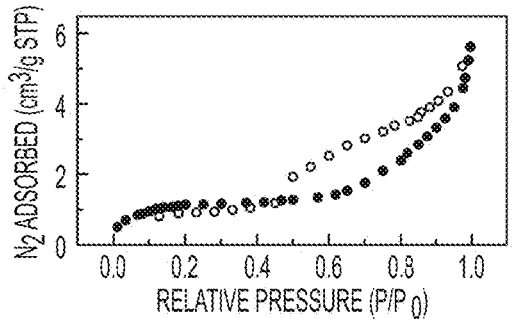
FIGS. 3A and 3B show nitrogen adsorption (A) and pore size distribution (B) for BTE fabric modification.
Figure 3B:
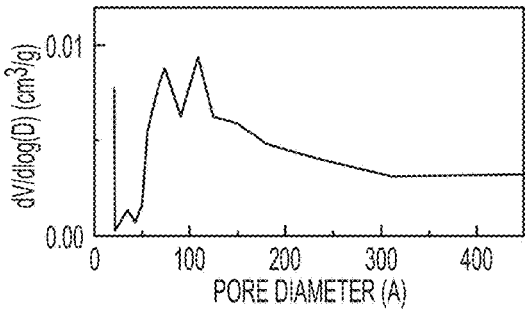

The second adapted material utilized only ethane bridging groups to provide a scaffold for further modification. The dip solution was prepared by mixing 1.9 g Pluronic P123, 0.5 g mesitylene, 2.12 g BTE, and 2 g methanol at room temperature. After thoroughly mixing, 6.07 g 0.1 M nitric acid was added drop-wise. The solution was stirred for 6 h with a tightly sealed lid. Fabric swatches were dipped into the preparation at 150 mm/min insuring that the wet fabric did not come into contact with solid surfaces. The swatches were cured while hanging at 60° C. for 24 h followed by 80° C. for 24 h. The Pluronic surfactant was then removed by heating the material in ethanol at 65° C. for 48 h followed by air drying at room temperature. Fabric swatches were dipped into the preparation at 150 mm/min while ensuring that the wet fabric did not come into contact with solid surfaces. The swatches were cured while hanging at 60° C. for 24 h followed by 80° C. for 24 h. The Pluronic surfactant was then removed by heating the material in ethanol at 65° C. for 48 h followed by air drying at room temperature Many of the applications developed around organosilicate sorbents are based on post-synthesis modification. In order to compare the modified fabrics to the powdered materials, the fabrics were similarly modified. Primary amine groups were added to the sorbent surfaces by incubating the modified fabrics in a solution of 3-aminopropyltriethoxysilane (APS) in toluene for 1 h. They were then rinsed in toluene and dried at 110° C. overnight. Porphyrin incorporation into the amine-functionalized sorbent was accomplished using 1-ethyl-3-(3-dimethylaminopropyl)carbodiimide (EDC) coupling chemistry. The material was placed in a solution of 5 mM EDC and 0.6 mM porphyrin in 100 mM MES buffer (2-(N-morpholino)ethanesulfonic acid). The solution was incubated overnight with agitation. The material was then rinsed with ethanol and water. Metals were incorporated into the porphyrin-functionalized material by heating in a solution of 1 mM metal salt in deionized water overnight. FIGS. 3A and 3B show nitrogen adsorption (A) and pore size distribution (B) for BTE fabric modification.

Target Adsorption, Permeation, and Photocatalysis

Figure 4A:
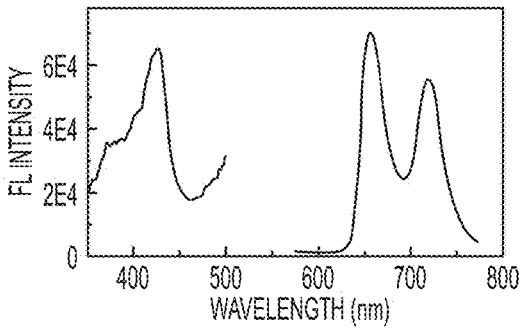
FIGS. 4A and 4B show fluorescence characteristics (A) for the meso-tetra(4-carboxyphenyl)porphyrin (C4) functionalized DEB-BTE fabric sample and target adsorption (B) by the C4 DEB-BTE fabric.
Figure 4B:
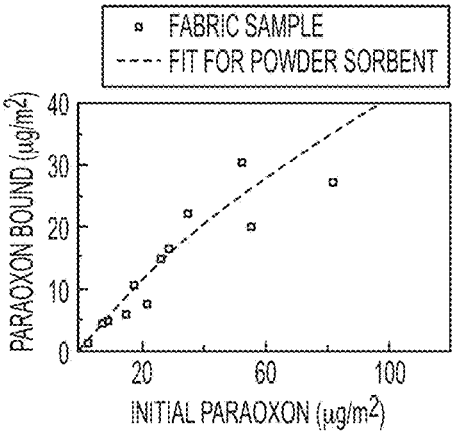

The fluorescence characteristics of fabric modified as above with meso-tetra(4-carboxyphenyl)porphyrin (C4) were evaluated. The characteristics were as expected, with slight indications of stacking as noted for the powdered materials. The characteristic excitation and emission bands were observed. Adsorption of targets from solution was also evaluated. The amount of adsorbed target was compared to the fit obtained for binding of paraoxon by the powdered materials. As shown in FIGS. 4A and 4B, the fabrics perform comparably to the powdered materials. FIGS. 4A and 4B show fluorescence characteristics (A) for the C4 functionalized DEB-BTE fabric sample and adsorption of the target paraoxon (B) by the same C4 DEB-BTE fabric.

Figure 5A:
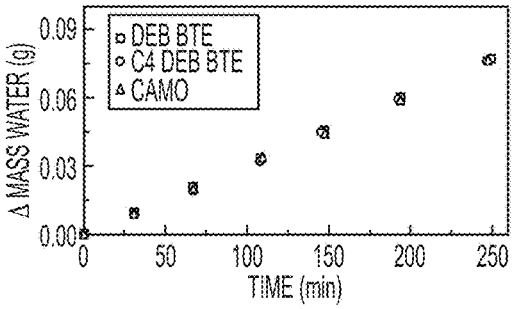
FIGS. 5A and 5B show water vapor permeation through fabrics. (A) ACU fabric alone, with the DEB-BTE modification, and with the C4 porphyrin on the DEB-BTE modification. (B) Cotton fabric alone, with the BTE modification, with the CuDIX porphyrin on the BTE modification, and with the C4 porphyrin on the DEB-BTE modification.
Figure 5B:
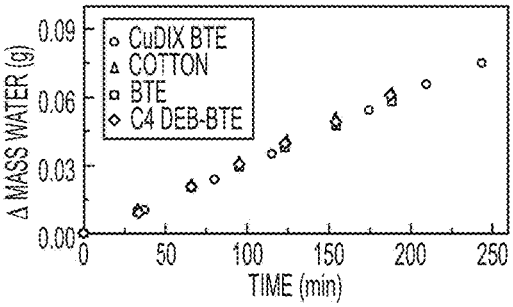
Figure 6A:
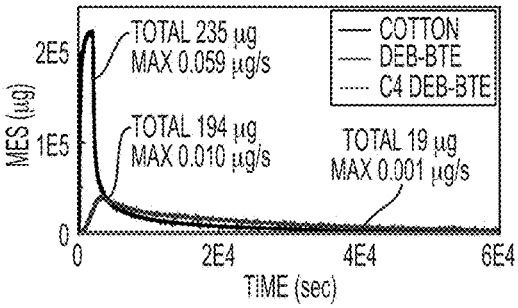
FIGS. 6A and B show methyl salicylate permeation through fabrics. (A) Cotton fabric alone, with the DEB-BTE modification, and with the C4 porphyrin on the DEB-BTE modification. (B) ACU fabric alone, with the DEB-BTE modification, and with the C4 porphyrin on the DEB-BTE modification.
Figure 6B:
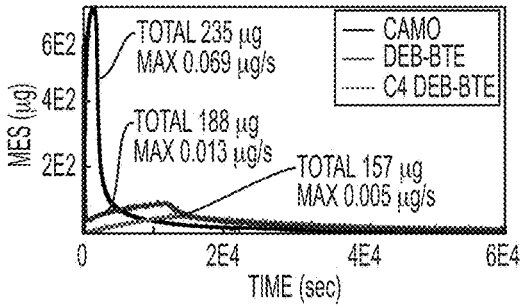
Figure 7A:
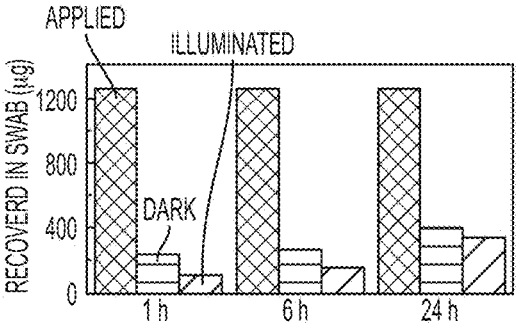
FIGS. 7A and 7B show paraoxon droplet permeation through cotton modified with C4 DEB-BTE. (A) target extracted from adsorbent swab and (B) target extracted from the modified cotton. Results from both illuminated and dark experiments are presented.
Figure 7B:
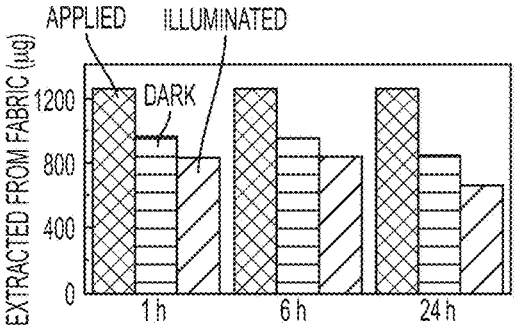

For application to a protective garment, water permeation is a serious consideration. The transport of water across the material is necessary for comfort as well as for thermal regulation. When the functionalized materials were evaluated, water transport across the functionalized fabrics was found to be nearly identical to that across the base fabrics (FIGS. 5A and 5B). Permeation of targets, on the other hand, was strongly impacted by functionalization of the fabrics. Here, methyl salicylate was used as a model compound. FIGS. 6A and B present data for both the cotton and ACU fabrics with/without the DEB-BTE modification and with/without C4 porphyrin. Both the total target passing through the material (area under the curve) and the peak target (maximum concentration) were reduced for the functionalized materials with the porphyrin functionalization showing the greatest reduction in target permeation. The BTE modification with copper Deuteroporphyin IX (CuDIX) is designed for the capture of targets such as phosgene and HD mustard. FIGS. 7A and 7B show permeation of half mustard (2-chloroethyl ethyl sulfide; CEES) and phosgene through the materials. In the CEES evaluation a single layer of fabric is used while the phosgene analysis utilized pleated material with a total of 12 layers. Both evaluations demonstrate significant target removal by the functionalized fabrics.

Figure 8A:
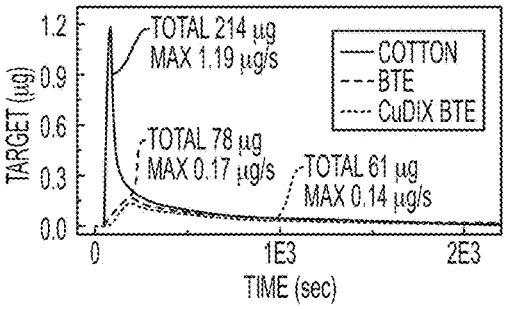
FIGS. 8A and 8B show shows CEES (A) and phosgene (B) permeation through fabrics. (A) Cotton fabric alone, with the BTE modification, and with the CuDIX porphyrin on the BTE modification. (B) ACU fabric CuDIX porphyrin on the BTE modification equilibrated at 0% and 45% relative humidity.
Figure 8B:
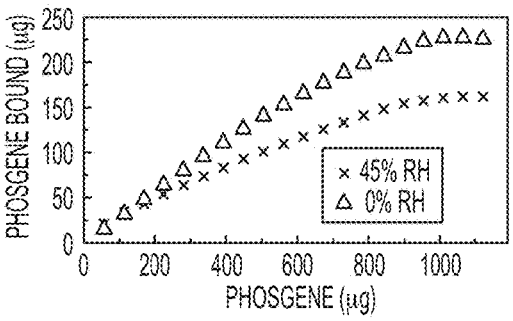

Droplet permeation through fabrics is also a consideration for protective applications. Targets delivered as aerosols may form droplets on tent fabrics for which there is no pressure applied. For a protective garment, droplets may be acquired through leaning or pressing a part of the body against a previously contaminated surface, for example kneeling on contaminated flooring. The C4 DEB-BTE materials were evaluated to determine how they would perform under this type of situation. The materials were evaluated under both dark and illuminated conditions to assess the potential of photocatalytic activity for removal of the target. Fabric samples (cotton) were placed on top of an adsorbent swab and a droplet of paraoxon was placed on the fabric. In the case of the cotton fabric, 75% of the paraoxon passed through the fabric and into the swab within the first hour. The remainder of the target was adsorbed into the fibers of the cotton and could be extracted. For the functionalized fabric (FIGS. 8A and 8B), approximately 20% of the target passed through the sample with no illumination after 1 h with a total of 32% on the swab after 24 h. Under illumination, 7% passed through the fabric to the swab in the first hour with a total of 26% after 24 h. In the absence of illumination, target not recovered from extraction of the swab was recovered when the fabric was extracted. Under illumination the total target recovered from the swab and the fabric was less than that applied indicating photocatalytic activity in the modified fabric.

Materials of the type described here provide the potential for increased reactive or catalytic surface area in protective applications. They also provide the potential for selectivity in the design of protective fabrics. These approaches can be applied to the generation of garments, shelters, or pleated filtration materials.

Concluding Remarks

All documents mentioned herein are hereby incorporated by reference for the purpose of disclosing and describing the particular materials and methodologies for which the document was cited.

Although the present invention has been described in connection with preferred embodiments thereof, it will be appreciated by those skilled in the art that additions, deletions, modifications, and substitutions not specifically described may be made without departing from the spirit and scope of the invention. Terminology used herein should not be construed as being "means-plus-function" language unless the term "means" is expressly used in association therewith.

REFERENCES

1. C. T. Kresge; M. E. Leonowicz; W. J. Roth; J. C. Vartuli; J. S. Beck, 1992, "Ordered mesoporous molecular sieves synthesized by a liquid-crystal template mechanism," Nature 359, 710-712.
2. M. C. Burleigh; M. A. Markowitz; E. M. Wong; J. S. Lin; B. P. Gaber, 2001, "Synthesis of periodic mesoporous organosilicas with block copolymer templates," Chem Mater 13, 4411-4412.
3. Y. Goto; S. Inagaki, 2002, "Synthesis of large-pore phenylene-bridged mesoporous organosilica using triblock copolymer surfactant," Chem Commun 2410-2411.
4. R. J. P. Corriu; D. Leclercq, 1996, "Recent developments of molecular chemistry for sol-gel processes," Angewandte Chemie-International Edition in English 35, 1420-1436.
5. Q. S. Huo; D. I. Margolese; G. D. Stucky, 1996, "Surfactant control of phases in the synthesis of mesoporous silica-based materials," Chem Mater 8, 1147-1160.
6. K. Kosuge; T. Murakami; N. Kikukawa; M. Takemori, 2003, "Direct Synthesis of Porous Pure and Thiol-Functional Silica Spheres through the S+X−I+ Assembly Pathway," Chem. Mater. 15, 3184-9.
7. A. Matsumoto; H. Misran; K. Tsutsumi, 2004, "Adsorption characteristics of organosilica based mesoporous materials," Langmuir 20, 7139-7145.
8. A. Palaniappan; X. Su; F. E. H. Tay, 2006, "Functionalized mesoporous silica films for gas sensing applications," J Electroceram 16, 503-505.
9. F. Hoffmann; M. Cornelius; J. Morell; M. Fröba, 2006, "Silica-Based Mesoporous Organic-Inorganic Hybrid Materials," Angew Chem Int Edit 45, 3216-3251.

10. J. Weitkamp; M. Hunger; U. Rymsa, 2001, "Base catalysis on microporous and mesoporous materials: recent progress and perspectives," Micropor Mesopor Mat 48, 255-270.
11. D. Brunel; F. Fajula; J. B. Nagy; B. Deroide; M. J. Verhoef; L. Veum; J. A. Peters; H. van Bekkum, 2001, "Comparison of two MCM-41 grafted TEMPO catalysts in selective alcohol oxidation," Applied Catalysis a-General 213, 73-82.
12. B. J. Johnson; B. J. Melde; P. T. Charles; D. C. Cardona; M. A. Dinderman; A. P. Malanoski; S. B. Qadri, 2008, "Imprinted Nanoporous Organosilicas for Selective Adsorption of Nitroenergetic Targets," Langmuir 24, 9024-9029.
13. B. J. Johnson; B. J. Melde; P. T. Charles; M. A. Dinderman; A. P. Malanoski; I. A. Leska; S. A. Qadri, 2010, "Macroporous Silica for Concentration of Nitroenergetic Targets," Talanta 81, 1454-60.
14. B. J. Johnson; B. J. Melde; I. A. Leska; P. T. Charles; A. D. Hewitt, 2011, "Solid-phase extraction using hierarchical organosilicates for enhanced detection of nitroenergetic targets," J Environ Monitor 13, 1404-9.
15. B. J. Johnson; B. J. Melde; G. W. Peterson; B. J. Schindler; P. Jones, 2012, "Functionalized organosilicate materials for irritant gas removal," Chem Eng Sci 68, 376-382.
16. B. J. Johnson; N. E. Anderson; P. T. Charles; A. P. Malanoski; B. J. Melde; M. Nasir; J. R. Deschamps, 2011, "Porphyrin-Embedded Silicate Materials for Detection of Hydrocarbon Solvents," Sensors 11, 886-904.
17. B. J. Johnson; I. A. Leska; B. J. Melde; J. R. Taft, 2012, "Removal of phosgene by metalloporphyrin-functionalized porous organosilicates" Catal. Commun. 27, 105-8.
18. B. J. Johnson; I. A. Leska; B. J. Melde; J. R. Taft, 2012, "Self-Reporting Materials Dual Use for Porphyrin-Embedded Sorbents," Sensor Actuat B-Chem 176, 399-404.
19. B. J. Johnson; B. J. Melde; P. T. Charles; A. P. Malanoski, 2009, "Porphyrin-embedded organosilicas for detection and decontamination," 2009 SPIE International Defense, Security and Sensing Symposium, Orlando, Fla., #14.
20. B. J. Johnson; B. J. Melde; B. Lin; P. T. Charles; A. P. Malanoski; M. Nasir, 2010, "Functional and functionalized silicate materials," 2010 MRS Fall Meeting, Boston.
21. B. J. Johnson; B. J. Melde; C. Thomas; A. P. Malanoski; I. A. Leska; P. T. Charles; D. A. Parrish; J. R. Deschamps, 2010, "Fluorescent Silicate Materials for the Detection of Paraoxon," Sensors 10, 2315-2331.
22. B. J. Johnson; G. W. Peterson; P. Jones; B. J. Melde; J. R. Taft; B. J. Schindler, 2012, "Porphyrin-embedded organosilicate materials for ammonia adsorption," J Porphyr Phthalocya 16, 1-10.
23. B. Johnson-White; M. Zeinali; A. P. Malanoski; M. Dinderman, 2007, "Sunlight catalyzed conversion of cyclic organics with novel mesoporous organosilicas," Catalysis Comm 8, 1052-1056.
24. B. Johnson-White; M. Zeinali; K. M. Shaffer; J. C. H. Patterson; P. T. Charles; M. A. Markowitz, 2007, "Detection of organics using porphyrin embedded nanoporous organosilicas," Biosens Bioelectron 22, 1154-1162.
25. R. A. Hayn; J. R. Owens; S. A. Boyer; R. S. McDonald; H. J. Lee, 2011, "Preparation of highly hydrophobic and oleophobic textile surfaces using microwave-promoted silane coupling," Journal of Materials Science 46, 2503-2509.
26. K. Nakanishi; T. Amatani; S. Yano; T. Kodaria, 2008, "Multiscale Templating of Siloxane Gels via Polymerization-Induced Phase Separation," Chem Mater 20, 1108-1115.
27. K. Nakanishi; Y. Kobayashi; T. Amatani; K. Hirao; T. Kodaira, 2004, "Spontaneous Formation of Hierarchical Macro-Mesoporous Ethane-Silica Monolith," Chem Mater 16, 3652-3658.

RELATED PATENT

Norton, F. J., Schenectady, N.Y. "Waterproofing treatment of materials" U.S. Pat. No. 2,386,259 October 1945.

RELATED PUBLICATIONS

J. R. Owens; R. A. Hayn; S. A. Boyer; R. S. McDonald, 2008, "Synthesis of hydrophobic and oleophobic nylon-cotton fabric through microwave catalyzed silane attachment," AFRL Report #AFRL-RX-TY-TP-2008-4619, available through DTIC.
R. A. Hayn; J. R. Owens; S. A. Boyer; R. S. McDonald; H. J. Lee, 2011, "Preparation of highly hydrophobic and oleophobic textile surfaces using microwave-promoted silane coupling," Journal of Materials Science 46, 2503-2509.
K. Nakanishi; T. Amatani; S. Yano; T. Kodaria, 2008, "Multiscale Templating of Siloxane Gels via Polymerization-Induced Phase Separation," *Chem Mater* 20, 1108-1115.
K. Nakanishi; Y. Kobayashi; T. Amatani; K. Hirao; T. Kodaira, 2004, "Spontaneous Formation of Hierarchical Macro-Mesoporous Ethane-Silica Monolith," *Chem Mater* 16, 3652-3658.
B. J. Johnson; B. J. Melde; G. W. Peterson; B. J. Schindler; P. Jones, 2012, "Functionalized organosilicate materials for irritant gas removal," Chem Eng Sci 68, 376-382.
B. J. Johnson; I. A. Leska; B. J. Melde; J. R. Taft, 2012, "Removal of phosgene by metalloporphyrin-functionalized porous organosilicates" Catal. Commun. 27, 105-8.
B. J. Johnson; I. A. Leska; B. J. Melde; J. R. Taft, 2012, "Self-Reporting Materials: Dual Use for Porphyrin-Embedded Sorbents," Sensor Actuat B-Chem 176, 399-404.
B. J. Johnson; B. J. Melde; C. Thomas; A. P. Malanoski; I. A. Leska; P. T. Charles; D. A. Parrish; J. R. Deschamps, 2010, "Fluorescent Silicate Materials for the Detection of Paraoxon," Sensors 10, 2315-2331.
S. Sundarrajan, A. R. Chandrasekaran, S. Ramakrishna "An Update on Nanomaterials-Based Textiles for Protection and Decontamination," *J. Am. Ceram. Soc.* 2010, 93, 3955-3975.

What is claimed is:

1. A method of treating fabric, the method comprising:

wetting a fabric in a first solution comprising tetraethylorthosilicate (TEOS) to obtain a precursor fabric, and irradiating the precursor fabric with microwave radiation to obtain a TEOS functionalized fabric, wherein said organosilica precursor comprises:

(1) bis(trimethoxysilyl)ethane (BTE) and 1,4-bis(trimethoxysilylethyl)benzene (DEB); or (2) mesitylene and BTE.

2. The method of claim 1, wherein said first solution further comprises ammonium hydroxide.

3. The method of claim 1, further comprising:

dip-coating the TEOS functionalized fabric in a dip solution comprising surfactant and organosilica precursor to obtain dipped fabric, and curing the dipped fabric to obtain a modified fabric.

4. The method of claim 3, wherein said organosilica precursor comprises bis(trimethoxysilyl)ethane (BTE), the method further comprising chemically coupling a porphyrin to the BTE to obtain a porphyrin-functionalized fabric.

5. The method of claim 4, wherein said porphyrin is selected from the group consisting of meso-tetra(4-carboxyphenyl) porphyrin and copper Deuteroporphyin IX.

6. The method of claim 1, further comprising modifying the fabric with a functional group, catalyst, or optical indicator.

7. A modified fabric comprising:

a fabric in a state of being modified by wetting the fabric in a first solution comprising tetraethylorthosilicate (TEOS) to obtain a precursor fabric, irradiating the precursor fabric with microwave radiation to obtain a TEOS functionalized fabric, dip-coating the TEOS functionalized fabric in a dip solution comprising surfactant and organosilica precursor to obtain dipped fabric, and curing the dipped fabric to obtain a modified fabric.

8. The modified fabric of claim 7, wherein a porphyrin is chemically coupled to the fabric.

9. The modified fabric of claim 7, wherein a functional group, catalyst, or optical indicator is chemically coupled to the fabric.

10. A garment comprising the modified fabric of claim 7.

11. A shelter comprising the modified fabric of claim 7.

12. A filter comprising the modified fabric of claim 7.

13. A modified fabric comprising:

a fabric in a state of being modified by wetting the fabric in a first solution comprising tetraethylorthosilicate (TEOS) to obtain a precursor fabric, irradiating the precursor fabric with microwave radiation to obtain a TEOS functionalized fabric, wherein a functional group, catalyst, or optical indicator is chemically coupled to the fabric.

14. A garment comprising the modified fabric of claim 13.

15. A shelter comprising the modified fabric of claim 13.

16. A filter comprising the modified fabric of claim 13.

* * * * *